United States Patent [19]

King, Jr.

[11] Patent Number: 4,532,946

[45] Date of Patent: Aug. 6, 1985

[54] METHOD AND APPARATUS FOR TIPPING TOBACCO LEAVES PACKED IN BALES

[75] Inventor: Frank C. King, Jr., Richmond, Va.

[73] Assignee: Philip Morris Incorporated, New York, N.Y.

[21] Appl. No.: 599,848

[22] Filed: Apr. 12, 1984

[51] Int. Cl.[3] ..... A24B 5/00; A24B 7/06

[52] U.S. Cl. ..... 131/327; 131/290; 131/311; 131/317; 131/322

[58] Field of Search ..... 131/311, 313-314, 131/316-317, 320, 322, 290, 117-118, 327; 83/407-408, 435

[56] References Cited

U.S. PATENT DOCUMENTS

| | | | |
|---|---|---|---|
| 290,818 | 12/1883 | Tobin | 131/311 |
| 1,589,323 | 6/1926 | Roberts | 131/313 |
| 2,398,450 | 4/1946 | Rundell | 131/320 |
| 3,511,122 | 5/1970 | Sherril et al. | 83/435 |
| 4,449,540 | 5/1984 | Marshall et al. | 131/311 |

*Primary Examiner*—V. Millin
*Assistant Examiner*—H. Macey

[57] ABSTRACT

A tobacco bale tipping apparatus (10) delaminates tobacco bale (12) into slabs of tobacco. The slabs of tobacco are separated into right hand and left hand wedges (14) by conveyor belts (27) and (26) and by weight chains (24). The wedges (14) are tipped by knives (20) which are adjustable toward or away from the conveyors to accommodate tobacco leaves of various lengths.

7 Claims, 9 Drawing Figures

METHOD AND APPARATUS FOR TIPPING TOBACCO LEAVES PACKED IN BALES

BACKGROUND OF THE INVENTION

The present invention relates to preliminary processing of cured tobacco leaves for the purpose of making them into tobacco products such as filler for cigarettes. More particularly, the present invention relates to a method and apparatus for removing the tips of tobacco leaves prior to threshing.

The processing of tobacco leaves as conventionally practiced involves threshing of the tobacco to remove the stems from the lamina or leafy portion. In the past, tobacco arrived at the stemmery in hands. Each hand consisted of a plurality of leaves oriented in the same direction so that their stems projected. Another tobacco leaf was wrapped around the projecting butt end of the stems. When hands of tobacco were received at the stemmery, they could be easily tipped and the tips of the tobacco leaves processed separately from the rest of the tobacco leaves, thereby reducing the breakage and damage to the lamina found in the tips caused by threshing.

More recently, Burley and Maryland tobaccos have been packed in small bales on the farm. In packing a bale of tobacco, a handful of leaves is placed with stem-ends oriented toward one side of a container used to form the bale. Another handful of leaves is placed at the other side of the container used to form the bale with the tips overlapping the tips of the first handful of leaves. This is continued until the container for the bale is partially full and then the stack is compacted. The process is repeated until the container is full. The bale is bound and then removed from the container. This method of packing tobacco leaves in bales is well known in the tobacco industry.

Tobacco arriving at the stemmery in bales, rather than hands, is not easily tipped in the manner that the hands of tobacco were tipped. As an alternative to tipping, the entire bale can be put through the threshing process to separate the lamina from the stem. However, putting the entire tobacco leaf through the threshing process unnecessarily degrades the quality of the tip ends of the tobacco leaf which contain little or no stem structure, thus reducing the yield of strip of good size for filling capacity.

Heretofore, attempts have been made to mechanically tip bales of tobacco packed in the standard rectangular tobacco bale with varying degrees of success. Sherrill et al, U.S. Pat. No. 3,511,122 discloses the use of band saws for cutting baled tobacco. However, the apparatus disclosed in Sherill requires the use of a long, band type saw to cut the entire bale at one time. This method disregards the fact that the length of the tobacco leaves in the three foot long tobacco bale may vary from less than eighteen inches to approximately thirty inches. Depending on the length of leaves stacked in the tobacco bale, the individual leaves might be cut twice by the two blades, therefore producing a tipped section, a midrib section, and a butt section. Thus, the tip of the tobacco leaf on longer leaves would be processed with the butt end of the tobacco and the midrib section of the tobacco leaf would be processed as the tips were in tobacco bales packed with shorter leaves. This would eliminate the advantages produced by tipping since the midrib section often contains large and objectionable stems and veins. Adjusting the blades farther from the centerline will not correct the problem since the amount of tip removed will then include a substantial portion of the midrib.

It is, therefore, an object of the present invention to provide a bale tipping apparatus for removing the tips of baled tobacco leaves suitable for use regardless of the size of the individual leaves processed in each tobacco bale.

SUMMARY OF THE INVENTION

The present invention is a bale tipping apparatus wherein the tobacco bale is delaminated or flaked by suitable means such as a doffer to produce slabs or layers of tobacco several inches thick. These slabs of tobacco are comprised of wedges of tobacco. A spreading means separates the slabs of tobacco into right handed and left handed wedges with the tips of the right handed and left handed wedges separated to such an extent that the tipping blade or blades will remove only that portion of the tobacco leaf which is free of objectionable veins or stem.

DESCRIPTION OF THE INVENTION

The invention will now be described with reference to the drawings in which a number of representative embodiments of the present invention, some of which are particularly preferred, are disclosed.

Figure 1:
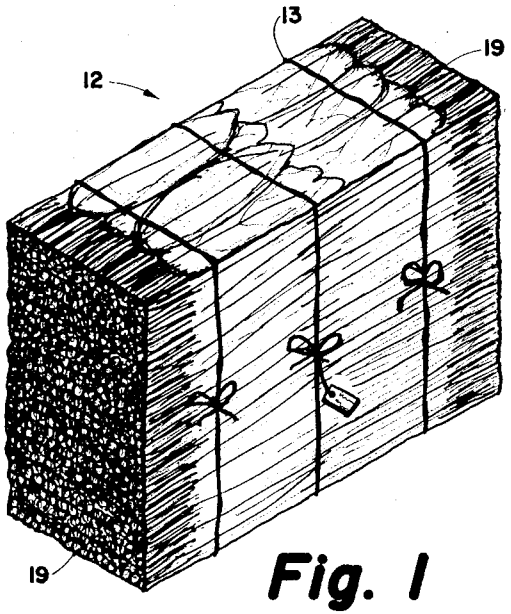
FIG. 1 is a perspective view of a tobacco bale.

FIG. 1 shows a bale of tobacco 12 as it is received at the stemmery. The butt ends 19 of the tobacco leaves face outward on both ends of the tobacco bale 12. The tobacco bale dimensions are approximately one foot wide by three feet long by two feet high. The tobacco bale is bound by ties 13. Packing tobacco in bales is well known prior art.

Figure 2:
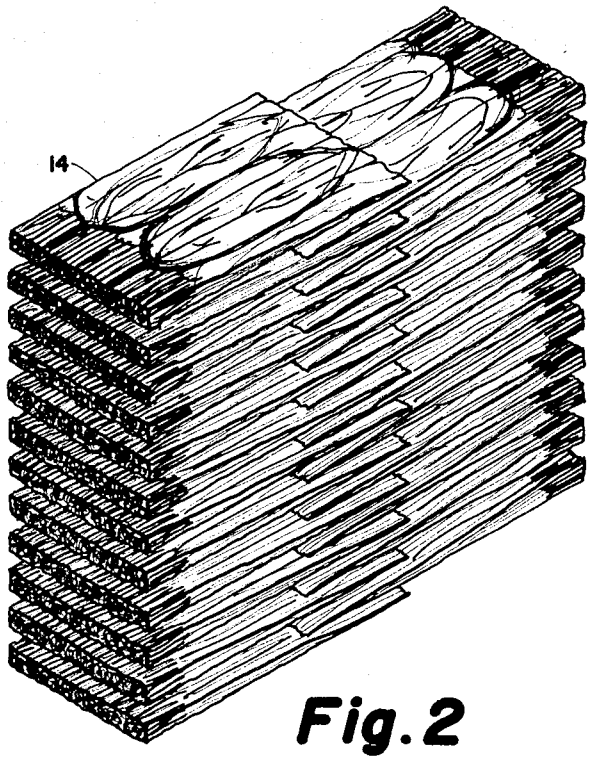
FIG. 2 is an expanded view of a tobacco bale.
Figure 3:
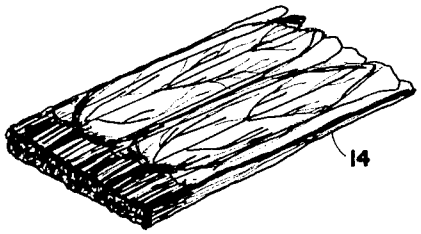
FIG. 3 is a perspective view of a typical wedge of tobacco.

In FIG. 2, the tobacco bale has been expanded for the purposes of showing the wedges of tobacco which form the tobacco bale. A single wedge of tobacco is shown in FIG. 3.

Figure 4:
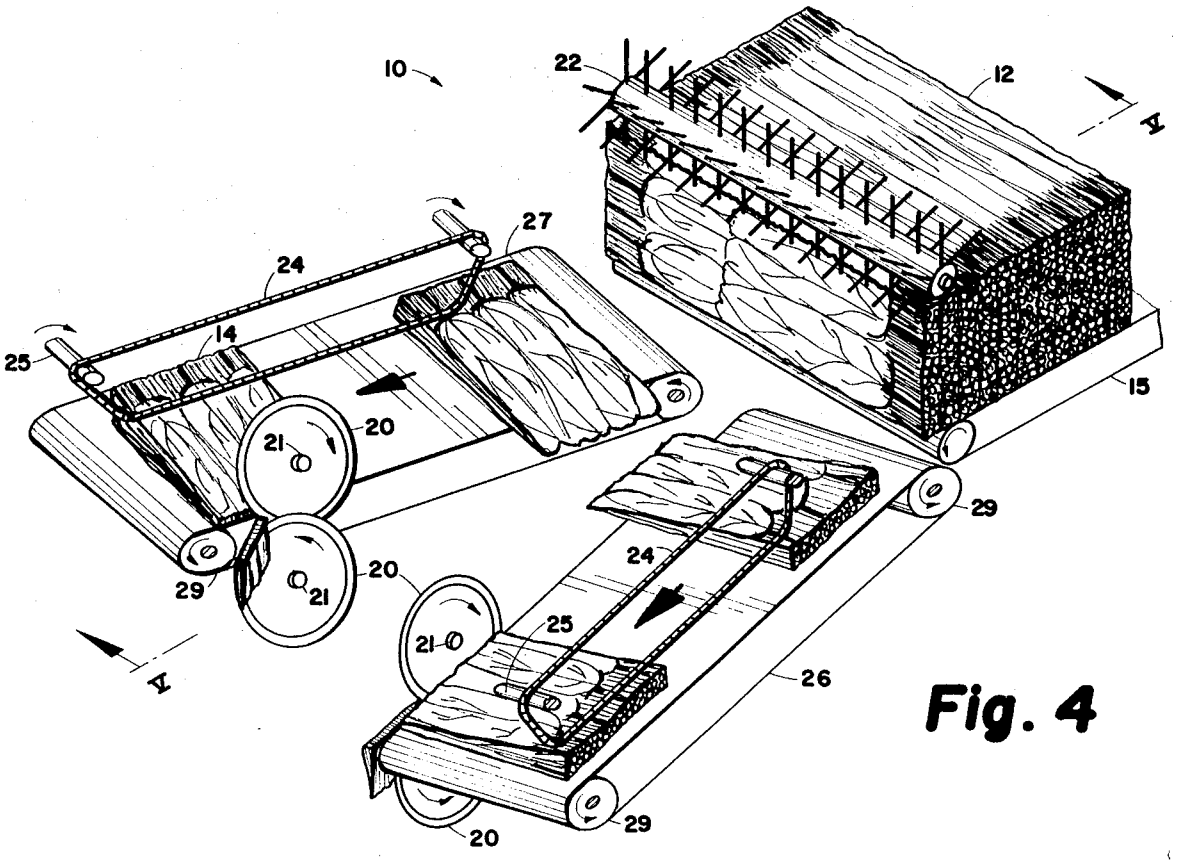
FIG. 4 is a perspective view of a tobacco bale tipping apparatus according to the present invention.

FIG. 4 shows an apparatus for tipping tobacco designated in general by reference numeral 10. Tobacco bales 12 enter the tipping apparatus with their stems oriented in an outward direction as shown with either the top or bottom of the bale first. The tobacco bale 12 is moved toward doffer 22 by conveyor 15.

Doffer 22 separates slabs of tobacco from the bale. The slabs of tobacco are removed by conveyors 26 and 27 which are in turn mounted on rollers 29. Rollers 29 may be driven in the direction shown by any conventional means. The distance between conveyors 26 and 27 is less at the end at which the tobacco bale 12 enters, than at the knife end. As the slabs of tobacco advance along conveyor belts 26 and 27, the slabs are separated into right handed and left handed wedges 14 as the conveyors move apart. As the slabs are separated into wedges, the tip ends of the tobacco leaves in each wedge hang over the edge of the conveyor. The width of the conveyor is narrow enough so that the shortest leaf of tobacco will have some overhang.

The wedges of tobacco are held on conveyor belts 26 and 27 by weight chains 24. Chains 24 are driven by chain drive shafts 25 at a speed such that the chains advance at the same rate as conveyor belts 26 and 27. The weight chains hold each wedge of tobacco so that the butt ends are located near the outer edge of the conveyors.

As shown in FIG. 4, rotating knives 20 are mounted for rotation on shafts 21. Each conveyor has an associated pair of knives, one knife in each pair being mounted below and cooperating with the other so as to cut the tips off the tobacco leaves in a scissor like manner as is well known in the art. Knives 20 may be adjustable toward or away from conveyors 26 and 27 to vary the length of tip removed. Thus, to remove the tips from short leaves of tobacco, the knives would be adjusted so that they are located very close to the edge of the conveyors and remove essentially all of the tips in each wedge that hang over the edge of the conveyor. For very long tobacco leaves, the knives must be adjusted farther away from the conveyor in order to remove only the tip of the tobacco leaves, leaving the midrib attached to the butt.

Figure 5:
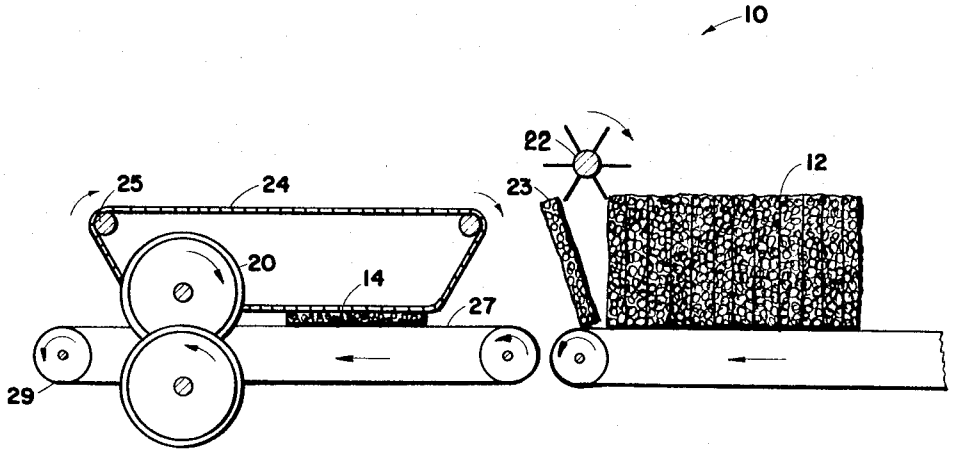
FIG. 5 is a cross sectional view of the tobacco bale tipping apparatus shown in FIG. 4.

Thus, it is seen that a tobacco bale tipping apparatus according to the present invention will remove only that portion of a tobacco leaf desirable for processing without threshing regardless of the length of the leaf. FIG. 5 shows the bale tipping apparatus in cross section along line V—V of FIG. 4.

Figure 6:
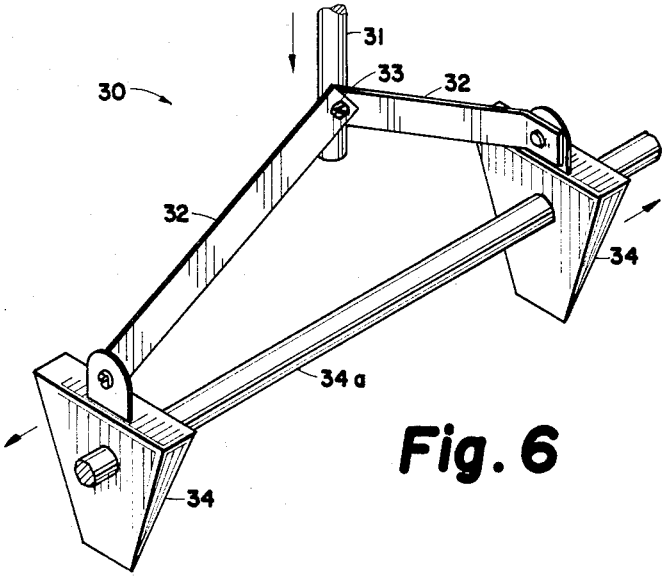
FIG. 6 is a perspective view of an alternative means of separating layers of a tobacco bale.

There are alternative means of accomplishing various portions of the present invention. For example, rather than using doffer 22 to remove slabs of tobacco from tobacco bale 12, a toggle 30 such as shown in FIG. 6 could be used to remove a slab 23 of tobacco from tobacco bale 12. The toggle operates as follows. As rod 31 is pushed toward bale 12, slider bars 32 rotate about pivot 33 causing tobacco grippers 34 to slide apart. Grippers are slidably mounted on bar 34*a*. Tobacco grippers 34 are inserted into the tobacco bale and thus separate the wedges of tobacco from the bale.

Figure 7:
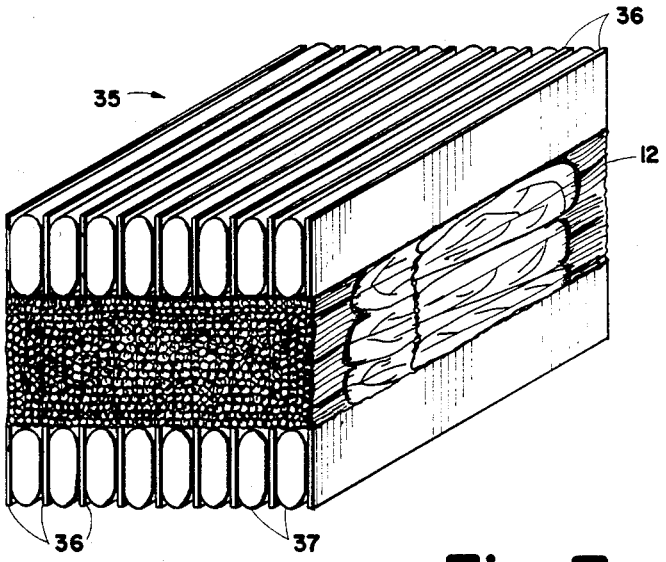
FIG. 7 is a perspective view of yet another means of separating layers of a tobacco bale.

Another method of separating tobacco bale 12 into wedges is shown in FIG. 7. Separator 35 consists of blades 36 and bladders 37. Blades 36 are pushed into tobacco bale 12. After insertion of blades 36 into tobacco bale 12, the bladders are expanded by air or other means to inflate the bladders and separate the blades, thus separating the tobacco bale into slabs.

Figure 8:
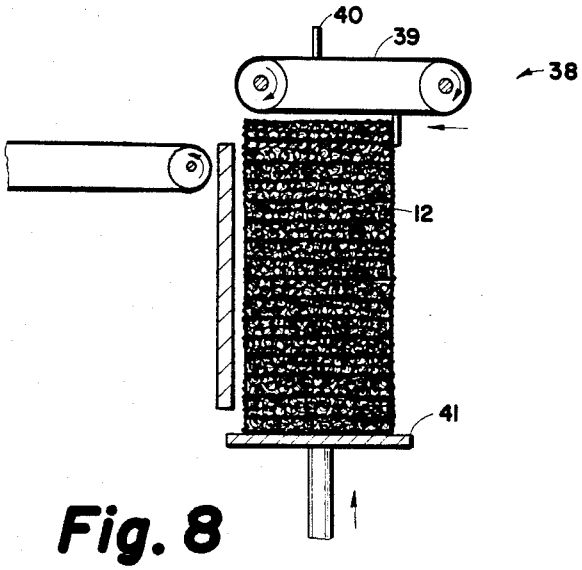
FIG. 8 is an additional means of separating layers of a tobacco bale.

FIG. 8 shows another method of removing slabs of tobacco from bale 12. This method uses a horizontal belt flaker 38 having a conveyor belt 39 with projections 40 and lift table 41 to remove slabs of tobacco from bale 12. Belt 39 is rotated in such a manner that the slab of tobacco at the top of bale 12 is removed as projections 40 come into contact with the bale. Lift table 41 is attached periodically or gradually to moves bale 12 upward so that as the next projection 40 rotates into position an additional slab is ready for removal.

Figure 9:
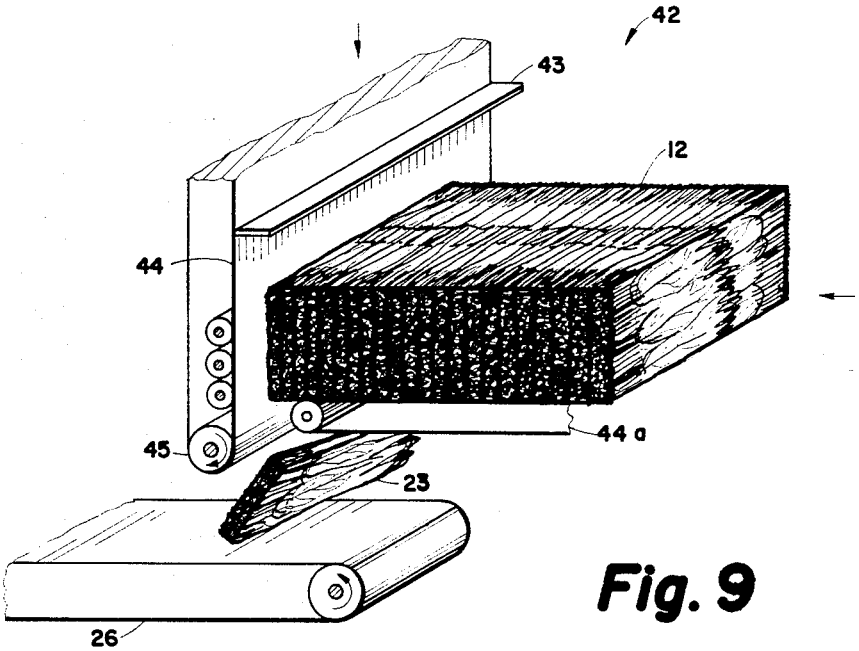
FIG. 9 is a further means of separating layers of a tobacco bale.

FIG. 9 shows a vertical belt flaker 42 for removing slabs of tobacco 23 from bale 12. In this embodiment, projections 43 are mounted on conveyor belt 44. Projection 43 removes a slab of tobacco as it come in contact with bale 12. Bale 12 is advanced by conveyor 44*a* periodically or continuously so that the next slab is ready for removal as the next projection 43 moves into position.

It is claimed:

1. A tobacco bale tipping apparatus comprising:
   flaking means for removing slabs of tobacco from a tobacco bale;
   spreading means for separating said slabs into right handed and left handed wedges of tobacco; and
   tipping means for removing the tips of the tobacco leaves from said right handed and left handed wedges of tobacco.

2. A tobacco bale tipping apparatus as in claim 1 wherein said flaking means is a doffer.

3. A tobacco bale tipping apparatus as in claim 1 wherein said spreading means is a diverging conveyor belt.

4. A tobacco bale tipping apparatus as in claim 1 wherein said tipping means are rotating tipping knives.

5. A bale tipping apparatus as in claim 1 wherein said flaking means is a toggle.

6. A tobacco bale tipping apparatus as in claim 1 wherein said flaking means comprises alternating blades and bladders.

7. A method of tipping tobacco leaves packed in a bale having left handed and right handed wedges of tobacco comprising:
   removing slabs of tobacco from said bale;
   separating said slabs of tobacco into right handed and left handed wedges; and
   separately removing the tips of tobacco leaves in said right handed and left handed wedges.

* * * * *